US006570479B2

(12) United States Patent
Colby

(10) Patent No.: US 6,570,479 B2
(45) Date of Patent: May 27, 2003

(54) LAMINATED TRANSFORMER SYSTEM AND METHOD

(75) Inventor: Gerald F. Colby, Landcaster, WI (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 101 days.

(21) Appl. No.: 09/897,203

(22) Filed: Jul. 2, 2001

(65) Prior Publication Data

US 2003/0001714 A1 Jan. 2, 2003

(51) Int. Cl.[7] ..... H01F 27/24

(52) U.S. Cl. ..... 336/234; 336/212; 336/216; 336/217; 29/602.1

(58) Field of Search ..... 29/609, 602.1, 29/605, 606, 607; 310/42; 336/210, 212, 234, 216, 217

(56) References Cited

U.S. PATENT DOCUMENTS 4,602,236 A * 7/1986 Shelby et al. ..... 336/216
5,672,963 A * 9/1997 Corrigall et al. ..... 323/339
5,861,792 A * 1/1999 Ueda et al. ..... 336/234

* cited by examiner

*Primary Examiner*—Anh Mai

(57) ABSTRACT

The invention provides a transformer system and method of attaching a laminated housing on the same. The transformer system includes a laminated housing with a plurality of laminates. A coil assembly producing a magnetic field is positioned within the laminated housing. At least one low power weld is positioned on the laminated housing to bond the laminates together without substantially disrupting the magnetic field. The method of attaching the laminated housing on the transformer includes applying a low power weld to the laminated housing including a plurality of laminates. The laminates are bonded together without substantially disrupting a magnetic field produced by a coil assembly positioned within the laminated housing.

22 Claims, 2 Drawing Sheets

LAMINATED TRANSFORMER SYSTEM AND METHOD

TECHNICAL FIELD OF THE INVENTION

The present invention relates to transformers, and more specifically, the invention relates to a laminated transformer system and method.

BACKGROUND OF THE INVENTION

Transformers are electrical devices commonly used to transfer an alternating current or voltage from one electric circuit to another by means of electromagnetic induction. A transformer typically consists of two or more conductor windings placed on the same iron core magnetic path. The conductor windings, or coils, produce a magnetic field flux that is associated with the electrical current that passes through them. The iron core is generally made up of sheets or laminations of rolled iron, such as electrical grade steel. Laminating the core minimizes magnetic eddy current production and hysteresis. The iron may be treated so that it has a high magnetic conduction quality, or permeability, throughout the length of the core. One application of a transformer, for example, is as a ballast component in a high-intensity discharge lamp. In this and other applications, the transformer should function in a quiet and efficient manner while minimizing heat production.

Currently, transformer cores may be welded at two locations that serve to hold the laminations primarily in a horizontal direction. A shortcoming of this welding strategy is that the individual laminations may separate at their corners in a vertical direction. Repeated handling or lifting of the transformer produces stress forces on the unit that may result in a 'fanning' of the lamination corners. The separation of the lamination corners may be visually unappealing and may even result in increased noise production and failure of the transformer.

In order to prevent the 'fanning' of the laminations, additional welds have been applied near the corners of the transformer core. This strategy has been proven effective for preventing lamination separation, but has also resulted in disruption of the magnetic field flux. The additional material introduced by the weld and subsequent deformation of the transformer housing typically results in the formation of magnetic eddies and, as a consequence, hysteresis. This may reduce the efficiency of the unit and produce additional heat. As such, welding the laminations near the corners is not a practical solution for the prevention of 'fanning'.

In summary, the laminations of transformer cores are typically held together by a set of primary welds. The primary welds, however, do not prevent the separation of the laminations at their corners. Previous attempts to bond the laminations near their corners have resulted in reduced unit efficiency and increased hysteresis and heat generation of the transformer. Therefore, it would be desirable to achieve a strategy for bonding the transformer laminations in a manner that overcomes the aforementioned and other disadvantages.

SUMMARY OF THE INVENTION

One aspect of the invention provides a transformer system. The transformer system includes a laminated housing with a plurality of laminates. A coil assembly producing a magnetic field is positioned within the laminated housing. At least one low power weld is positioned on the laminated housing to bond the laminates together without substantially disrupting the magnetic field. The low power weld may comprise a tungsten inert gas weld and may comprise a low penetration weld. The low power weld may be applied with a power setting of about 100 amps and may be positioned adjacent an outer edge of the laminated housing. At least one primary weld may be applied on the laminated housing to bond the laminates together. The primary weld may be applied with a power setting of about 170 amps. The laminates may comprise an electrical grade steel material and may comprise a magnetic core. The coil assembly may be disposed on the magnetic core.

Another aspect of the invention provides a method of attaching a laminated housing on a transformer. The method includes applying a low power weld to the laminated housing including a plurality of laminates. The laminates are bonded together without substantially disrupting a magnetic field produced by a coil assembly positioned within the laminated housing. The low power weld may comprise a tungsten inert gas weld and may comprise a low penetration weld. The low power weld may be applied with a power setting of about 100 amps and may be positioned adjacent an outer edge of the laminated housing. At least one primary weld may be applied on the laminated housing to bond the laminates together. The primary weld may be applied with a power setting of about 170 amps. The laminates may comprise an electrical grade steel material and may comprise a magnetic core. The coil assembly may be disposed on the magnetic core.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
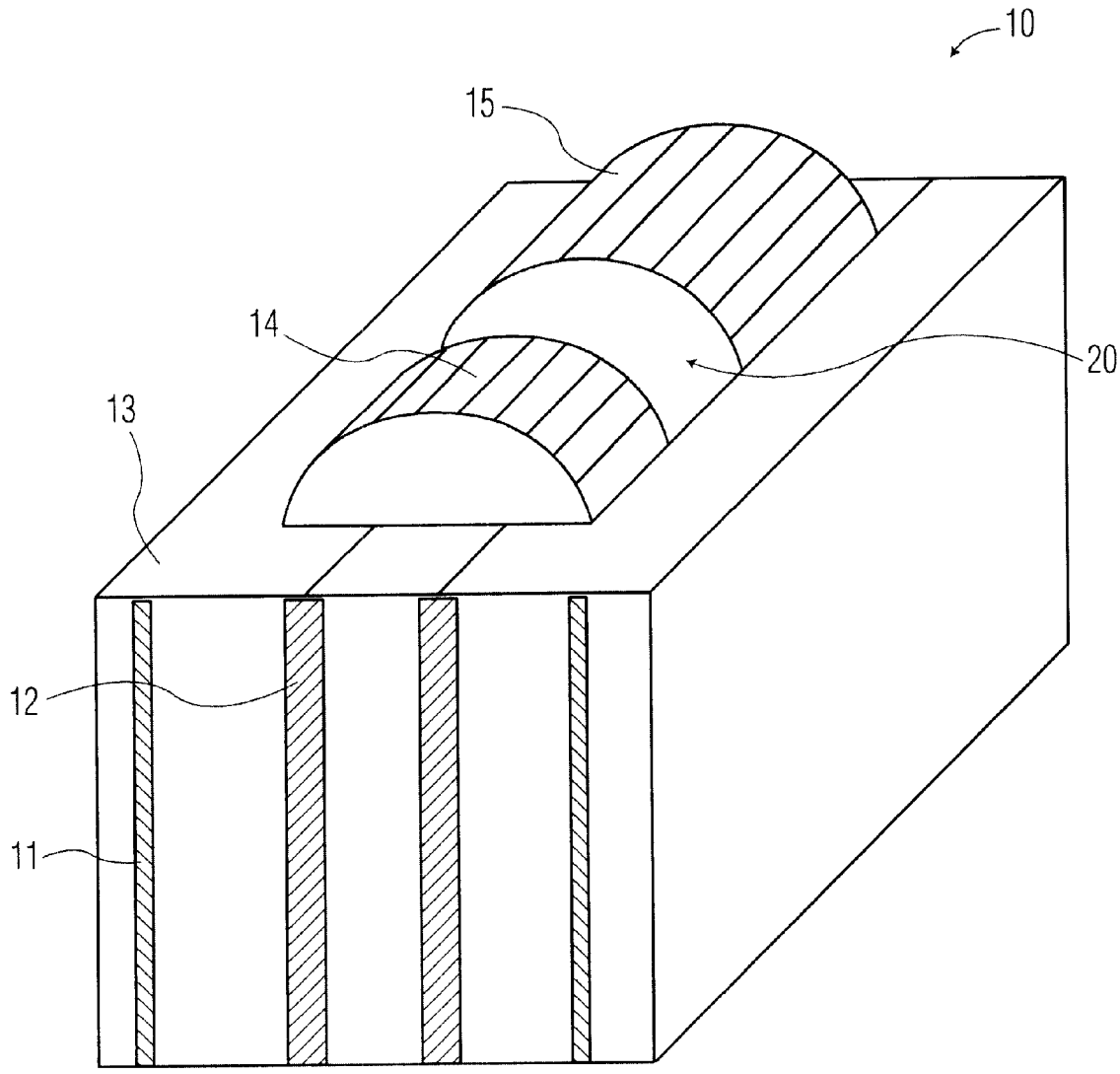
FIG. 1 is a perspective view of one embodiment of the present invention.

Referring to the drawings, shown in FIG. 1 is an elevated perspective view of one embodiment of the present invention designated in the aggregate as numeral 10. The transformer system 10 may include a laminated housing 13, at least one low power weld 11, at least one primary weld 12, and a coil assembly 20 including a first coil 14 and second coil 15. The laminated housing 13 may include a plurality of laminates that form a magnetic core.

Figure 2:
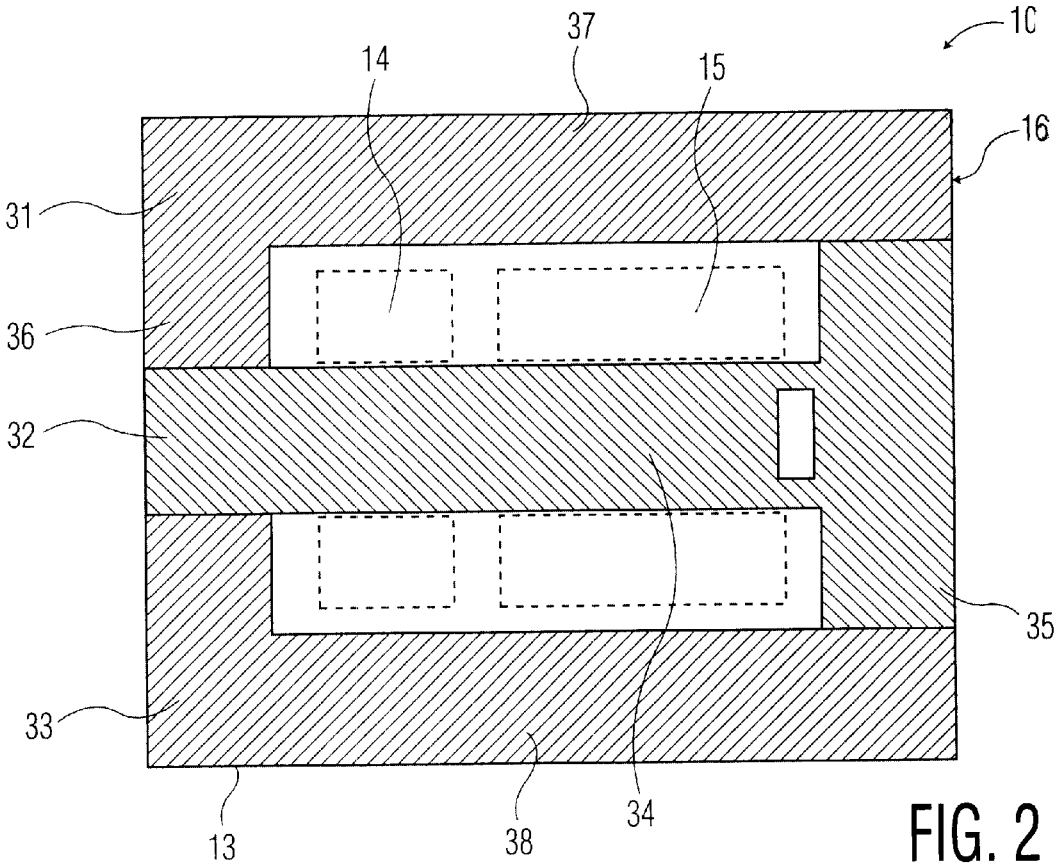
FIG. 2 is an elevated perspective view of the embodiment shown in FIG. 1.

As further shown in FIG. 2, a laminate 16 of one embodiment may include three separate components 31, 32, and 33. The components may be arranged to form a double-window type configuration known in the art. For example, a centrally located leg 34 and two parallel yokes 35,36 positioned perpendicular to and at opposite ends of the central leg 34. The two yokes 35,36 project laterally outward from the central leg 34 and are joined at both ends by outer legs 37,38. The outer perimeter of the arranged laminate components 31, 32, and 33 may form the laminated housing 13. The components may form laminates for a single-window type, a cross or modified type, or other configuration type transformer. The laminate 16 need not be manufactured from separate components.

Figure 3:
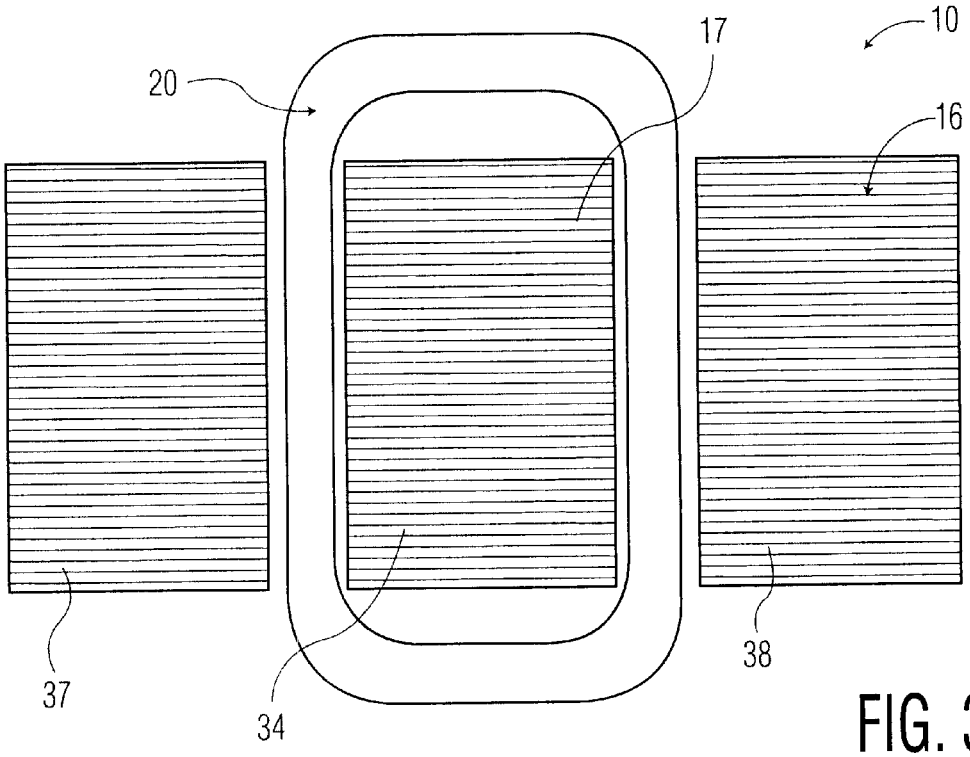
FIG. 3 is a cross-section view of the embodiment shown in FIG. 1.

As further shown in cross-section in FIG. 3, a plurality of laminates 16 may be positioned parallel and adjacent to one another in a stacked arrangement. The laminates 16 may be manufactured from an electrical grade steel material and may comprise a magnetic core 17. In one embodiment, the laminates 16 may be treated to obtain a high magnetic conduction quality, or permeability, throughout the length of the magnetic core 17. Those skilled in the art will recognize that a variety of laminate materials, treatments, components, and arrangements may be selected for use in the present invention.

Referring now to FIGS. 1, 2, and 3, the coil assembly 20 may be positioned within the laminated housing 13. In one embodiment, the coil assembly may include a first coil 14 and a second coil 15 disposed on the magnetic core 17. The coils 14,15 may be positioned adjacent to one another and coaxially with the central leg 34. In another embodiment, the coil assembly 20 may be positioned on separate legs. The coils 14,15 may each include a wire, or winding, wound around the coil axis to carry an electrical current. Each winding may be electrically connected to a circuit. During transformer 10 operation, the first coil 14 winding may be energized by a primary electrical current to produce a magnetic field flux. The magnetic field flux, then, may induce a secondary electrical current within the secondary coil 15 winding. The secondary electrical current may be proportional to the nature of the wire windings. The nature of the wire windings includes factors such as wire composition, number of windings, and the like. Those skilled in the art will recognize that the nature of the wire windings may be varied for use in the present invention.

At least one low power weld 11 may be applied on the laminated housing 13 to bond the laminates 16 together. In one embodiment, two low power welds 11 may be applied on each of opposing laminated housing 13 sides. Each low power weld 11 may be placed adjacent an outer edge of the laminated housing 13 side. The use of low power weld(s) 11 may ensure that the magnetic field produced by the coil assembly 20 is not substantially disrupted during transformer operation. In one embodiment, the low power weld 11 may comprise a tungsten inert gas weld. The low power weld 11 may be applied with an electrical welding power setting of about 100 amps. In one embodiment, the low power weld 11 may comprise a low penetration weld. The aforementioned types of low power welds minimize laminate deformation thereby preventing eddy formation and subsequent magnetic field disruption. Furthermore, the low power weld(s) 11 may prevent the 'fanning' of the laminated housing corners and may reduce transformer noise production. Those skilled in the art will recognize that the low power weld(s) may be applied in a variety of positions and orientations on the laminated housing to achieve one or more of the aforementioned advantages.

At least one primary weld 12 may be applied on the laminated housing 13 to bond the laminates 16 together. In one embodiment, two primary welds 12 may be applied on each of opposing laminated housing 16 sides. The primary weld(s) may be placed at the joints of the laminate components 31, 32, and 33 to functionally bond said components together and the laminates 16 to one another. In one embodiment, the primary weld 12 may be applied with a power setting of about 170 amps. The use of primary weld(s) 12 is known in the art and may bond the laminates 16 in a single direction as in, for example, a horizontal direction. The primary weld(s) 12 may not, by themselves, prevent the 'fanning' of the laminated housing 13 corners.

A method for attaching a laminated housing 13 to a transformer 10 may include applying a low power weld 11 to the laminated housing 13. The laminated housing 13 may include a plurality of laminates 16. The laminates 16 may be bonded together without substantially disrupting a magnetic field produced by a coil assembly 20. The coil assembly 20 may be positioned within the laminated housing 13. The low power weld 11 may comprise a tungsten inert gas weld and may comprise a low penetration weld. The low power weld 11 may be applied with a power setting of about 100 amps and may be positioned adjacent an outer edge of the laminated housing 13. At least one primary weld 12 may be applied on the laminated housing 13 to bond the laminates 16 together. The primary weld 12 may be applied with a power setting of about 170 amps. The laminates 16 may comprise an electrical grade steel material and may comprise a magnetic core 17. The coil assembly 20 may be disposed on the magnetic core 17.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A method of attaching a laminated housing on a transformer comprising:

applying a low power weld to the laminated housing including a plurality of laminates; and bonding the laminates together without substantially disrupting a magnetic field produced by a coil assembly positioned within the laminated housing.

2. The method of claim 1 wherein the low power weld comprises a tungsten inert gas weld.

3. A transformer system constructed by the method of claim 2.

4. The method of claim 1 wherein the low power weld comprises a low penetration weld.

5. A transformer system constructed by the method of claim 4.

6. The method of claim 1 wherein the low power weld is applied with a power setting of about 100 amps.

7. A transformer system constructed by the method of claim 6.

8. The method of claim 1 wherein the low power weld is positioned adjacent an outer edge of the laminated housing.

9. A transformer system constructed by the method of claim 8.

10. The method of claim 1 further comprising applying at least one primary weld on the laminated housing to bond the laminates together.

11. The method of claim 10 wherein the primary weld is applied with a power setting of about 170 amps.

12. A transformer system constructed by the method of claim 11.

13. A transformer system constructed by the method of claim 10.

14. The method of claim 1 wherein the laminates comprise an electrical grade steel material.

15. A transformer system constructed by the method of claim 14.

16. The method of claim 1 wherein the laminates comprise a magnetic core.

17. The method of claim 16 wherein the coil assembly is disposed on the magnetic core.

18. A transformer system constructed by the method of claim 17.

19. A transformer system constructed by the method of claim 16.

20. A transformer system constructed by the method of claim 1.

21. A method for constructing a transformer system, comprising:

constructing a laminated housing for a coil assembly; and bonding the laminate means together without substantially disrupting a magnetic field produced by the coil assembly.

22. A method for constructing a transformer system, comprising:

a step for constructing a laminated housing for a coil assembly; and a step for bonding the laminate means together without substantially disrupting a magnetic field produced by the coil assembly.

* * * * *